US006330757B1

(12) United States Patent
Russell

(10) Patent No.: US 6,330,757 B1
(45) **Date of Patent: *Dec. 18, 2001**

(54) FOOTWEAR WITH ENERGY STORING SOLE CONSTRUCTION

(75) Inventor: Brian A. Russell, Littleton, CO (US)

(73) Assignee: Britek Footwear Development, LLC, Boulder, CO (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/135,974

(22) Filed: Aug. 18, 1998

(51) Int. Cl.[7] ..... A43B 13/18
(52) U.S. Cl. ..... 36/28; 36/27; 36/29
(58) Field of Search ..... 36/28, 25 R, 30 R, 36/32 R, 30 A, 31, 35 R, 37

(56) References Cited

U.S. PATENT DOCUMENTS

| | | | | |
|---|---|---|---|---|
| Re. 33,066 | | 9/1989 | Stubblefield . | |
| D. 321,975 | | 12/1991 | Amulf et al. . | |
| D. 326,956 | | 6/1992 | Damianoe et al. . | |
| D. 331,832 | | 12/1992 | Issler . | |
| D. 343,272 | | 1/1994 | James . | |
| D. 347,105 | | 5/1994 | Johnson . | |
| 904,891 | | 11/1908 | Otlerstedt . | |
| 1,382,180 | | 6/1921 | Emery . | |
| 1,778,089 | | 10/1930 | Pomerantz . | |
| 1,993,208 | | 3/1935 | Cohn . | |
| 2,058,975 | | 10/1936 | Gray . | |
| 2,549,343 | | 4/1951 | Stoiner . | |
| 2,811,791 | | 11/1957 | Cox . | |
| 3,086,532 | | 4/1963 | Mistarz . | |
| 3,100,354 | | 8/1963 | Lomard et al. . | |
| 3,290,801 | | 12/1966 | Bente . | |
| 3,402,485 | | 9/1968 | McMorrow . | |
| 3,834,046 | * | 9/1974 | Fowler | 36/28 |
| 3,834,086 | * | 9/1974 | Fowler | 36/28 |
| 4,187,620 | | 2/1980 | Selner . | |
| 4,259,792 | | 4/1981 | Halberstadt . | |
| 4,266,349 | | 5/1981 | Schmohl . | |
| 4,335,530 | | 6/1982 | Stubblefield . | |
| 4,372,058 | | 2/1983 | Stubblefield . | |
| 4,798,009 | * | 1/1989 | Colonel et al. | 36/28 |
| 4,843,735 | * | 7/1989 | Nakanishi | 36/28 |
| 4,888,887 | | 12/1989 | Solow . | |
| 4,897,937 | | 2/1990 | Misevich et al. . | |
| 4,922,631 | | 5/1990 | Anderie . | |
| 4,956,927 | | 9/1990 | Misevich et al. . | |
| 4,999,931 | | 3/1991 | Vermeulen . | |
| 5,005,299 | | 4/1991 | Whatley . | |
| 5,092,060 | * | 3/1992 | Frachey et al. | 36/28 |
| 5,195,257 | * | 3/1993 | Holcomb et al. | 36/28 |
| 5,311,680 | | 5/1994 | Comparetto . | |
| 5,319,866 | | 6/1994 | Foley et al. . | |
| 5,367,791 | * | 11/1994 | Gross et al. | 36/25 R |
| 5,384,973 | | 1/1995 | Lyden . | |
| 5,440,826 | | 8/1995 | Whatley . | |
| 5,465,507 | | 11/1995 | Schumacher et al. . | |
| 5,595,003 | * | 1/1997 | Snow | 36/28 |
| 5,647,145 | * | 7/1997 | Russell et al. | 36/28 |
| 5,937,544 | * | 8/1999 | Russell | 36/28 |
| 6,195,915 | * | 3/2001 | Russell | 36/28 |

* cited by examiner

*Primary Examiner*—Paul T. Sewell
*Assistant Examiner*—Jila M. Mohandesi
(74) *Attorney, Agent, or Firm*—Knobbe, Martens, Olson & Bear LLP

(57) ABSTRACT

A sole is adapted for use with an article of footwear to be worn on the foot of a person while the person traverses along a support surface. This sole is operative to store and release energy resulting from compressive forces generated by the person's weight on the support surface. The sole is thus an improvement which can be incorporated with standard footwear uppers. Alternatively, the invention can be configured as an insert sole which can be inserted into an existing shoe and other article of footwear.

49 Claims, 8 Drawing Sheets

FIG. 1
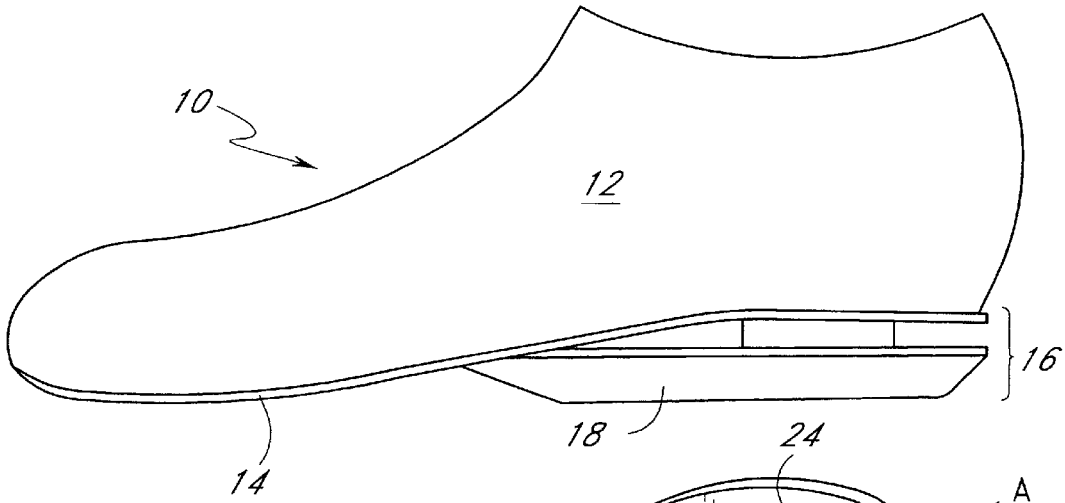
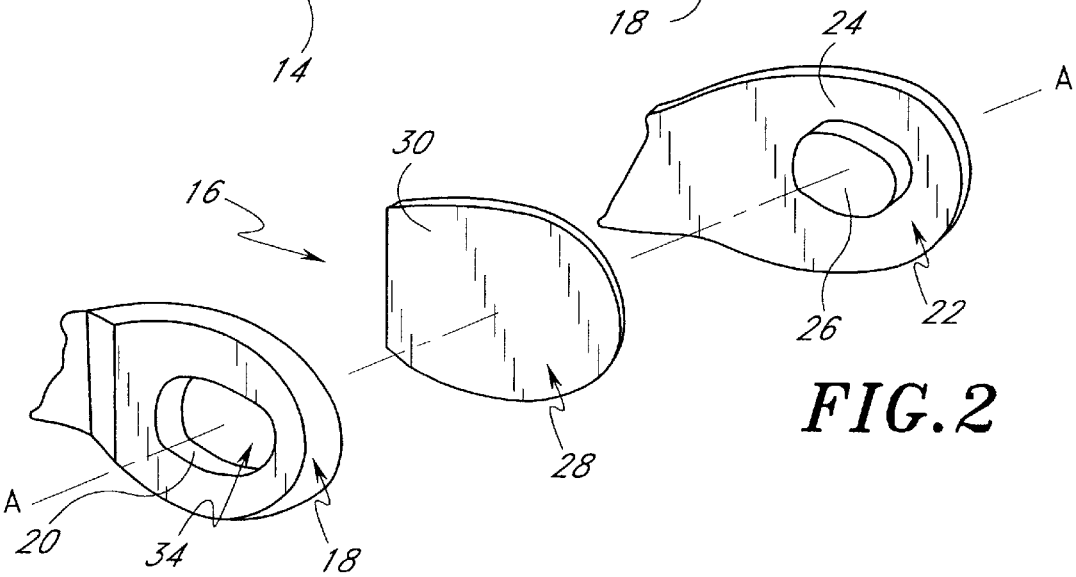
FIG. 2
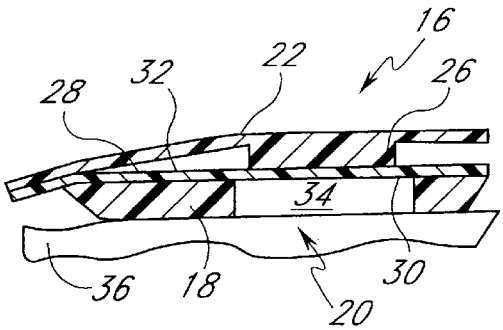
FIG. 3A
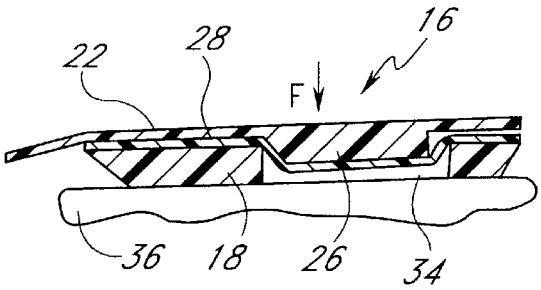
FIG. 3B

FIG. 4
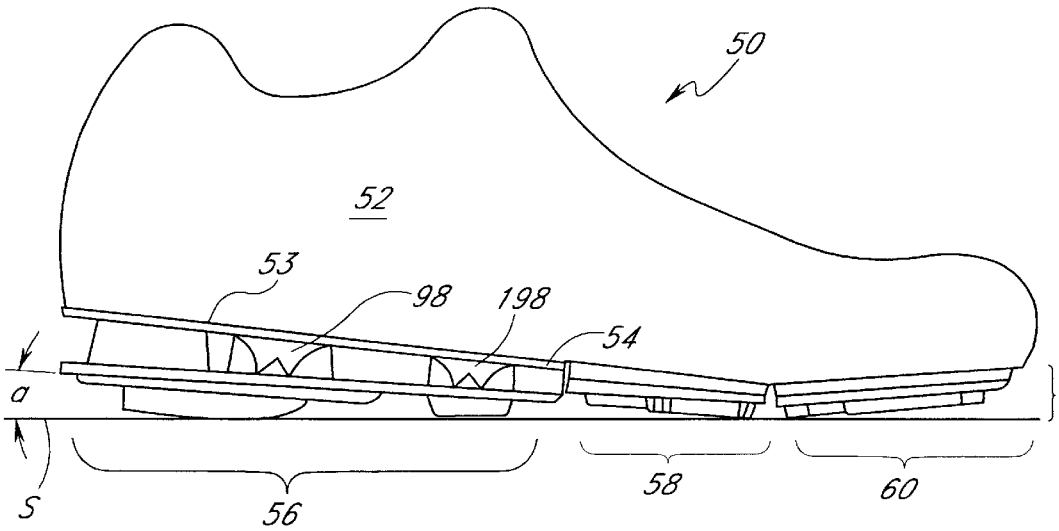
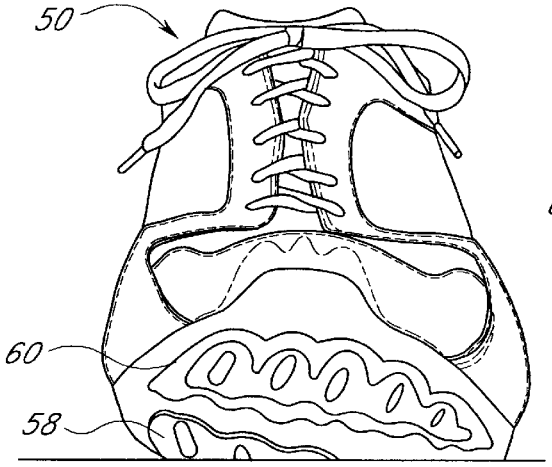
FIG. 5
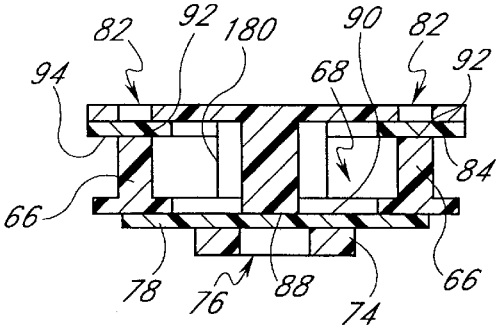
FIG. 8A
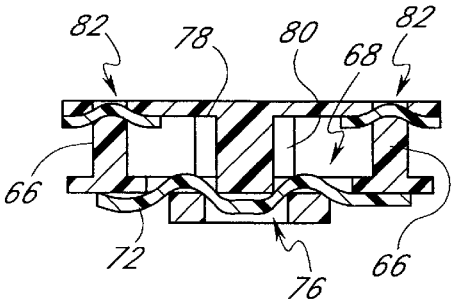
FIG. 8B

FOOTWEAR WITH ENERGY STORING SOLE CONSTRUCTION

FIELD OF THE INVENTION

The present invention broadly relates to articles of footwear that are adapted to be worn by a human, especially during athletic events. More particularly, however, the present invention is directed to a sole construction that may be incorporated into footwear or as an insert into existing footwear in order to store kinetic energy generated by the person. The footwear is thus particularly useful to return the energy stored so as to enhance performance of the footwear and thus the individual wearing the same.

BACKGROUND OF THE INVENTION

From the earliest times when humans began wearing coverings on their feet, there has been an ever present desire to make such coverings more useful and more comfortable. Accordingly, a plethora of different types of footwear has been developed in order to meet specialized needs of a particular activity in which the wearer intends to participate. Likewise, there have been many developments to enhance the comfort level of both general and specialized footwear.

One area of footwear which has received increasing attention in recent years has been athletic footwear. The increasing popularity of athletic endeavors has seen an increasing number of shoe design intended to meet the needs of the participants. The advancements in athletic shoe constructions have especially occurred where the participants are engaged in rigorous movements, such as running, jumping and the like.

It is well understood that, in typical walking and running gaits, one foot contacts the support surface (such as the ground) in a "stance mode" while the other foot is moving through the air in a "swing mode". During the stance mode, a respective foot travels through three successive basic phases: heel strike, mid-stance and toe-off. At faster running paces, the heel strike phase is usually omitted since the person tends to elevate onto his/her toes.

Typical shoe construction fails to completely address the needs of an athlete's foot and ankle during the various stages of the walking and running gait. Traditional shoe constructions result in a loss of a significant portion of the functional ability of the foot during these activities. Losses have been observed in the ability of the foot to absorb shock, in load musculature and tendon systems and in the propulsion of the body. One reason for these deficiencies is the failure of traditional shoe designs to address individually the heel, toes, tarsals, muscles and tendons of a person's foot.

Moreover, in vigorous athletic activities, the athlete generates kinetic energy from the motion of running, jumping, etc. Traditional shoe designs have served merely to dampen the shock from these activities thereby dissipating that energy. Rather than losing the kinetic energy produced by the athlete, it is useful to store and retrieve that energy thereby enhancing the athletic performance. Traditional shoe construction, however, has failed to address this need.

In the last several years, there have been some attempts to construct athletic shoes that provide some rebound thereby to return energy to the athlete. Various air bladder systems have been employed to provide a "bounce" during use. In addition, there have been numerous advancements and materials used to construct the sole the shoe in an effort to make them more "springy".

In my earlier invention disclosed in U.S. Pat. No. 5,647,145 issued Jul. 15, 1997, I teach an athletic footwear sole construction that enhances the performance of the shoe in several ways. First, the construction described in the '145 Patent individually addresses the heel, toe, tarsal and metatarsal regions of the foot to allow more flexibility so that the various portions of the sole cooperate with respective portions of the foot. In addition, a resilient layer is provided in the sole which cooperates with cavities formed at various locations to help store energy.

While the advancements in shoe constructions described above, including the '145 Patent, have provided a great benefit to the athlete, there remains a continued need for increased performance of athletic footwear. There remains a need for athletic footwear sole constructions that can store increasing amounts of kinetic energy for return to the athlete.

SUMMARY OF THE INVENTION

It is an object of the present invention to provide a new and useful sole construction that may be incorporated into footwear or used as an insert into existing footwear.

It is another object of the present invention to provide a structure for use with footwear that stores kinetic energy when a compressive weight is placed thereon and which releases that energy when the weight is taken off.

It is a further object of the present invention to provide footwear, and, specifically, a sole construction therefor, that enhances the performance of the footwear.

According to the present invention, then, a sole is adapted for use with an article of footwear to be worn on the foot of a person while the person traverses along a support surface. This sole is operative to store and release energy resulting from compressive forces generated by the person's weight on the support surface. This sole is thus an improvement which can be incorporated with standard footwear uppers. Alternatively, the invention can be configured as an insert sole which can be inserted into an existing shoe or other article of footwear.

In its broad form, the sole according to the present invention has a first layer of stretchable resilient material that has opposite first and second surfaces. A first profile is formed of a stiff material and is positioned on the first side of the resilient layer. The first profile includes a first profile chamber formed therein. This first profile chamber has an interior region opening toward the first surface of the resilient layer. The first profile in the resilient layer are positioned relative to one another so that the resilient layer spans across the first interior region. A second profile is also formed of a stiff material and is positioned on the second side of the resilient layer opposite the first profile. This second profile includes a primary actuator element that faces the second surface of the resilient layer to define a static state. The first and second profile are positioned relative to one another with the primary actuator element being oriented relative to the first profile chamber such that the compressive force between the foot and the support surface will move the first and second profiles toward one another. When this occurs, the primary actuator element advances into the first profile chamber thereby stretching the resilient layer into the interior region thereby to define an active state. In the active state, energy is stored by the resilient layer, and the resilient layer releases this energy to move the first and second profiles apart upon removal of the compressive force.

Preferably, the second profile has a second profile chamber formed therein. This second profile chamber has a second interior region opening toward the second surface of the resilient layer so that the resilient layer also spans across this second region. A plunger element is then provided and is disposed in the first interior region. This plunger element is operative to move into and out of the second interior region when the first and second profiles move between the static and active states. Here, also, a plurality of plunger elements may be disposed in the first interior region with these plunger elements operative to move into and out of the second interior region when the first and second profiles move between the static and active states. The plunger element may be formed integrally with the first layer of resilient material.

A third profile may also be provided, with this third profile having a third profile chamber formed therein. This third profile chamber has a third interior region. Here, a second layer of stretchable resilient material spans across the third region. The first profile then includes a secondary actuator element positioned to move into the third interior region and to stretch the second layer of resilient material into the third profile chamber in response to the compressive force. The first profile may also include a plurality of second actuators, and these actuators may extend around a perimeter thereof to define the first profile chamber. The third profile then has a plurality of third chambers each including a second layer of resilient material that spans thereacross. These third profile chambers each are positioned to receive a respective one of the secondary actuators. The first profile in the second actuator may also be formed as an integral, one-piece construction. The third profile and the plunger element may also be formed as an integral, one-piece construction.

The sole according to the present invention can be a section selected from a group consisting of heel sections, metatarsal sections and toe sections. Preferably, the sole includes one of each of these sections so as to underlie the entire foot but to provide independent energy storing support for each of the three major sections of the foot. In any event, the invention allows either of the first or second profiles to operate in contact with the support surface.

The present invention also contemplates an article of footwear incorporating the sole, as described above, in combination with a footwear upper. In addition, the present invention contemplates an insert sole adapted for insertion into an article of footwear.

These and other objects of the present invention will become more readily appreciated and understood from a consideration of the following detailed description of the exemplary embodiment(s) when taken together with the accompanying drawings, in which:

BRIEF DESCRIPTION OF THE DRAWINGS

FIG. 1 is a side view in elevation of a first exemplary embodiment of an article of footwear incorporating the heel portion of the sole according to the first exemplary embodiment of the present invention;

FIG. 2 is an exploded perspective view of the heel portion of the article of footwear shown in FIG. 1;

FIG. 3(*a*) is a side view in cross-section showing the heel portion of FIGS. 1 and 2 in a static state;

FIG. 3(*b*) is a side view in cross-section, similar to FIG. 3(*a*) except showing the heel portion in an active state;

FIG. 4 is a side view in elevation of an article of footwear having a sole constructed according to a second exemplary embodiment of the present invention;

FIG. 5 is an end view in elevation of the article of footwear shown in FIG. 4;

FIG. 8(*a*) is a rear end view in cross-section showing the heel portion of the sole of the article of footwear of FIG. 4 in a static state;

FIG. 8(*b*) is a cross-sectional view, similar to FIG. 8(*a*) but showing the heel portion in an active state;

FIG. 9(*b*) is a top plan view of the resilient layer used to form the toe portion of the sole of FIG. 4;

FIG. 9(*c*) is a top plan view of the second profile used to form the toe portion of the sole of FIG. 4;

FIG. 9(*d*) is a perspective view of an alternative construction of the resilient layer for the toe portion of the sole of FIG. 4;

FIG. 10(*b*) is a cross-sectional view similar to FIG. 10(*a*) but showing the toe portion in an active state;

FIG. 11(*b*) is a top plan view of the resilient layer used to form the metatarsal portion of the sole of FIG. 4;

FIG. 11(*c*) is a top plan view of the second profile used to form the metatarsal portion of the sole of FIG. 4;

FIG. 14(*b*) is a perspective view of the second profile used to form the toe portion of the sole insert of FIG. 12;

FIG. 15(*b*) is a perspective view of the second profile used to form the metatarsal portion of the sole insert of FIG. 12;

FIG. 16(*b*) is a perspective view of the second profile used to form the heel portion of the sole insert of FIG. 12.

DETAILED DESCRIPTION OF THE EXEMPLARY EMBODIMENTS

Figure 6:
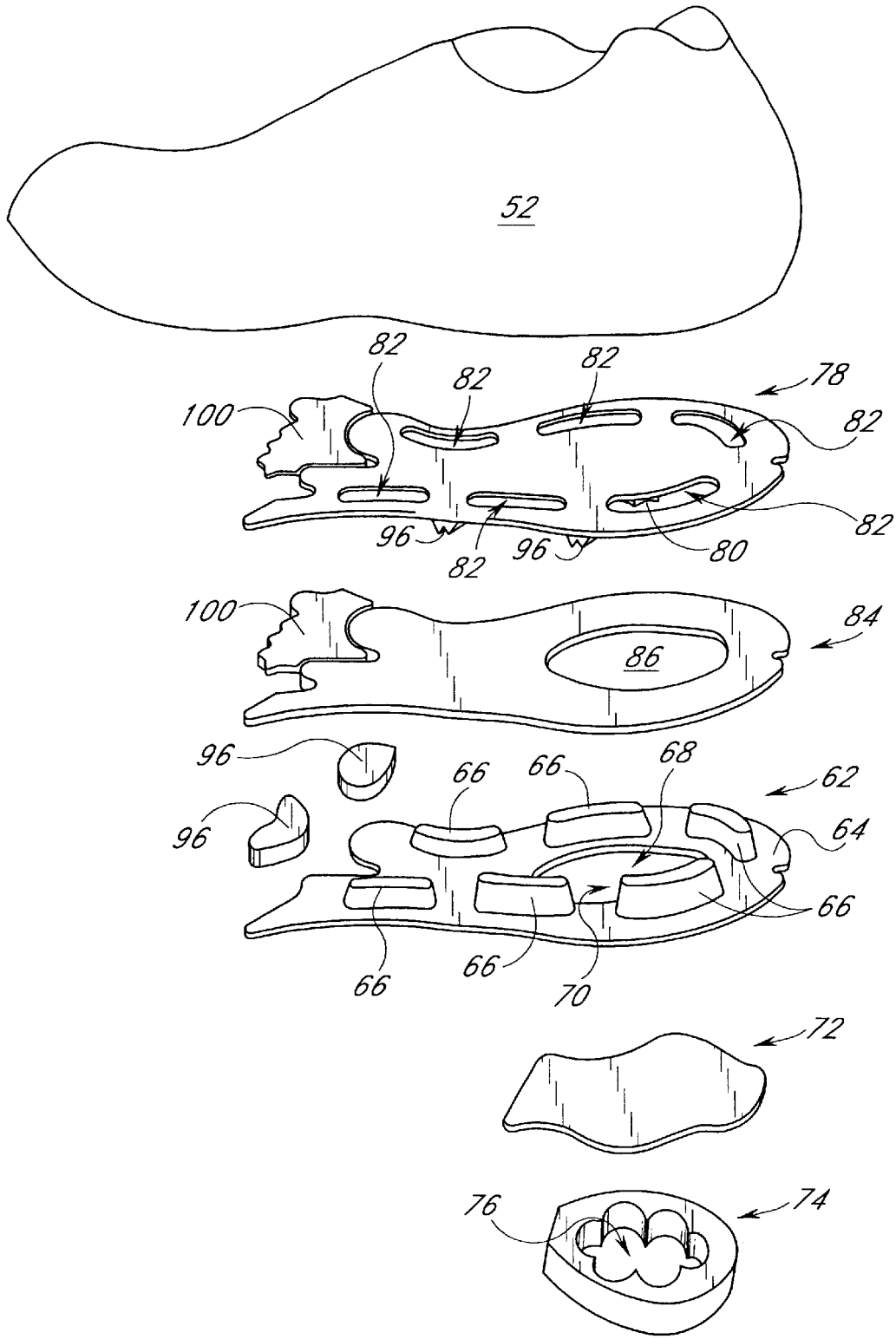
FIG. 6 is an exploded perspective view of the heel portion of the article of footwear shown in FIG. 4.

The present invention is directed to articles of footwear incorporating a sole either as an integral part thereof or as an insert wherein the sole is constructed so as to absorb, store and release energy during active use. Thus, it should be appreciated that the invention includes such a sole, whether alone, as an insert for an existing article of footwear or incorporated as an improvement into an article of footwear. In any event, the sole is adapted to be worn on the foot of a person while traversing along a support surface and is operative to store and release energy resulting from compressive forces between the person and the support surface.

With reference first to FIGS. 1–3, a first exemplary embodiment of the present invention is shown to illustrate its most simple construction. As may be seen in FIG. 1, an article of footwear in the form of an athletic shoe 10 has an upper 12 and a sole 14. Sole 14 includes a heel portion 16 that is constructed according to the first exemplary embodiment of the present invention.

The structure of heel portion 16 is best shown with reference to FIGS. 2, 3(*a*) and 3(*b*). In these figures, it may be seen that heel portion 16 includes a first profile in the form of a heel piece 18 that is formed of a relatively stiff material such as rubber, polymer, plastic or similar material. Heel piece 18 includes a first profile chamber 20 centrally located therein with first profile chamber 20 being oval in configuration and centered about axis "A". A second profile 22 is structured as a flat panel 24 that is provided with a primary actuator 26 that is similarly shaped but slightly smaller in dimension than first profile chamber 20. Second profile piece 22 is also formed of a stiff material, such as rubber, polymer, plastic or similar material. Actuator 26 can be formed integrally with flat panel 24 or, alternatively, affixed centrally thereon in any convenient manner.

The first layer 28 of a stretchable resilient material is interposed between heel piece 18 and second profile piece 22 so that resilient layer 28 spans across first profile chamber 20. To this end, it may be appreciated that heel piece 18 is positioned on a first side 30 of first resilient layer 28 while the second profile piece 22 is positioned on a second side 32 of first resilient layer 28 with actuator 26 facing the second side thereof. Moreover, it may be seen that first profile chamber 20 has a first interior region 34 that is sized to receive actuator 26.

With reference to FIGS. 3(*a*) and 3(*b*), it may be seen that heel piece 18 and second profile piece 22 are positioned so that a compressive force between the first and the support surface 36 in the direction of vector "F" moves heel piece 18 and second profile piece 22 toward one another. During this movement, the primary actuator element 26 advances into the first profile chamber 20. As this happens, resilient layer 28 is stretched into the first interior region 34 to define the active state shown in FIG. 3(*b*). In the active state, energy is stored by the stretching of resilient layer 28. However, when the compressive force is removed, resilient layer 28 operates to release the energy thereby to move heel piece 18 and second profile piece 22 apart from one another to return them to the static stage shown in FIG. 3(*a*). Accordingly, in operation, when a user places weight on the heel portion 16, either from walking, running or jumping, the impact force is cushioned and absorbed by the stretching of resilient layer 28. When the user transfers weight away from heel portion 16, this energy is released thereby helping propel the user in his/her activity.

The simple structure shown in FIGS. 1–3 can be expanded to make a highly active sole, such as that shown in the second exemplary embodiment of the FIGS. 4–11. With reference to FIG. 4, it may be seen that an article of footwear in the form of an athletic shoe 50 has an upper 52 and a sole 54 with sole 54 being constructed according to the second exemplary embodiment of the present invention. Sole 54 includes a heel portion 56, a metatarsal portion 58 and a toe portion 60, all described below in greater detail. Thus, when reference is made to a "sole" it may be just one of these portions, a group of portions or a piece that underlies the entire foot or a portion thereof.

Figure 7:
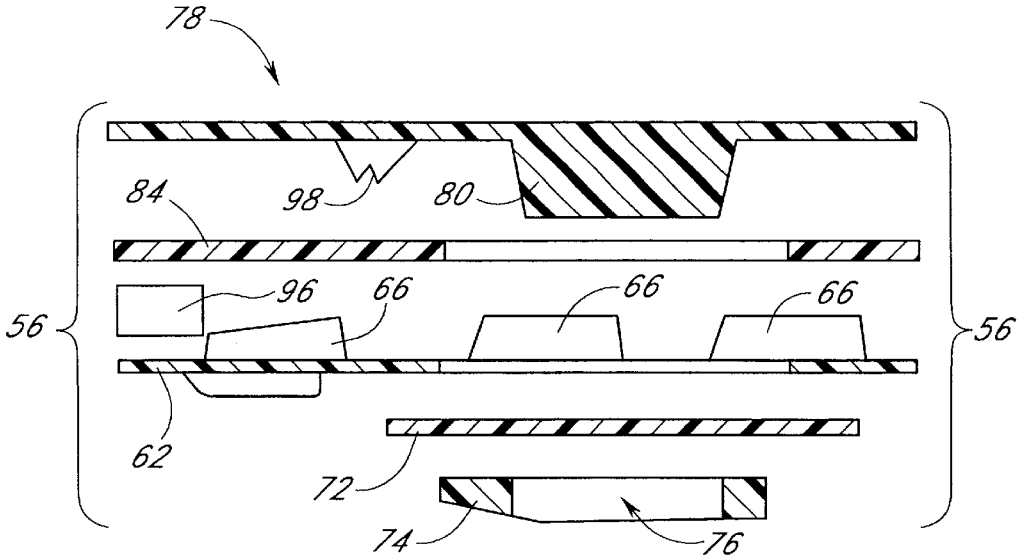
FIG. 7 is a side view in partial cross-section and exploded to show the construction of the heel portion of FIG. 6.

Turning first, then, to heel portion 56, the structure of the same may best be shown with reference to FIGS. 6–8. In these figures, it may be seen that heel portion 56 includes a first profile 62 formed by an annular heel plate 64 that has a plurality of spaced apart auxiliary actuator elements 66 positioned around the perimeter. Actuator elements 66 are formed of a stiff, fairly rigid material and define a first profile chamber 68 which has an opening 70 formed in annular heel plate 64. A layer of resilient stretchable material 72 is configured so that it will span across opening 70 with heel plate 64 and resilient layer 72 being secured together such as by an adhesive or other suitable means. Thus, first profile piece 62 is positioned on one side of resilient layer 72, and a second profile piece 74 is positioned on a second side of resilient layer 72 and is affixed thereto in any convenient manner. Second profile piece 74 is in the form of a heel piece but defines a primary actuator element for interaction with chamber 70. Thus, when used in this application, the phrase "second profile including a primary actuator element" can mean either that a second profile is provided with an independent actuator element or that the profile itself forms such actuator element.

In any event, it may further be appreciated that second profile piece 74 has a second profile chamber 76 formed centrally therein with second profile chamber 76 being an elongated six-lobed opening. Heel portion 56 then includes a third profile piece 78 that is provided with a plunger element 80 that is geometrically similar in shape to second profile chamber 76 but that is slightly smaller in dimension. Third profile piece 78 also includes a plurality of openings 82 that are sized and oriented to receive secondary actuator elements 66 noted above. To this end, also, heel portion 56 includes a second resilient layer 84 which has an elongated oval opening 86 centrally located therein. Openings 82 define third profile chambers each having a third interior region.

With reference now to FIGS. 7 and 8(*a*), it may be understood that, when nested, the various pieces which make up heel portion 56 form a highly active system for storing energy. Here, it may be seen that plunger 80 of a selected height so that, when nested, surface 88 of plunger 80 contacts the second side 90 of resilient layer 72. Simultaneously, upper surfaces 92 of secondary actuators 66 just contact surface 94 of second resilient layer 84. Each of secondary actuator elements 66 align with a respective opening 82 with openings 82 having a similar shape as the configuration of actuator 66 but slightly larger in dimension. Second profile piece 74 is then aligned so that second profile chamber 76 is positioned to receive plunger 80 when second profile piece 74 moves into the interior region of first profile chamber 68.

This movement, from the static state shown in FIG. 8(*a*) is depicted in the active state of FIG. 8(*b*). Here it may be seen that resilient layer 72 is forced to go a dual stretching wherein first profile piece 62, second profile piece 74 and plunger 80 counteract in a dual "piston-like" action. Resilient layer 72 is accordingly stretched both into first profile chamber 68 (by second profile piece 74) and into the interior region of second profile chamber 76 (by plunger 80).

At the same time, second resilient layer 84 undergoes a single deflection into each of the third profile chambers formed by openings 82. It should be now be appreciated that by making the third profile chambers small in vertical dimension, the undersurface 53 of upper 52 provides a limit stop so that peripheral support is attained by second actuator elements 66 while the primary energy storing occurs with the coaction of plunger 80 and second profile piece 74 on resilient layer 72. To further assist in lateral stability, auxiliary positioning blocks 96 may be employed along with optional soft lugs 98 which extend downwardly between third profile piece 78 and second resilient layer 84. Moreover, optional metatarsal support plates 100 may be employed if desired.

With reference again to FIG. 4, it may be seen that sole 54 is constructed so as to be oriented at a slight acute angle "a" relative to support surface "S" when in the static state, with heel portion 56 being elevated relative to toe portion 60. Preferably angle "a" is in a range of about 2 degrees to 6 degrees. By providing this small angle, the release of the energy from the active state is not simply in the vertical direction during mid-stance to toe-off. Rather, since sole 54 pivots about the toe portion 60, the restorative force therefore is angled slightly forwardly during this movement. This results in a component of the restorative force being transferred to propel the user in a forward direction.

Figures 9A, 9B, 9C:
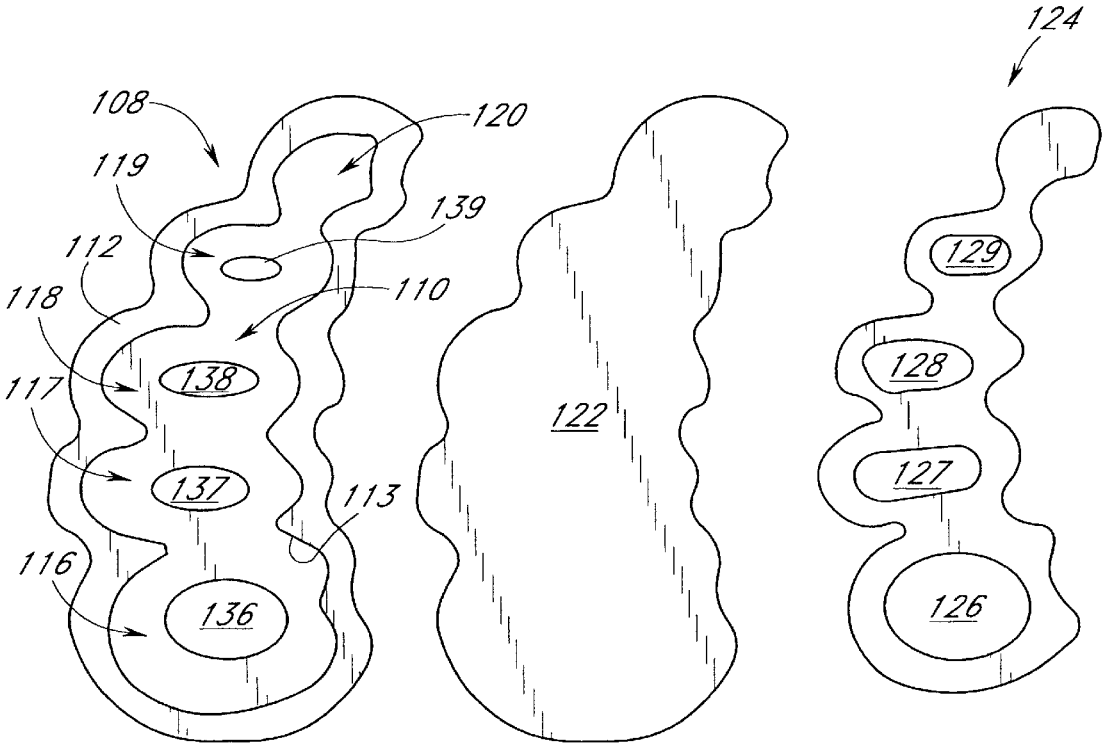
FIG. 9(*a*) is a top plan view of the first profile used for the toe portion of the sole of FIG. 4.
Figure 9D:
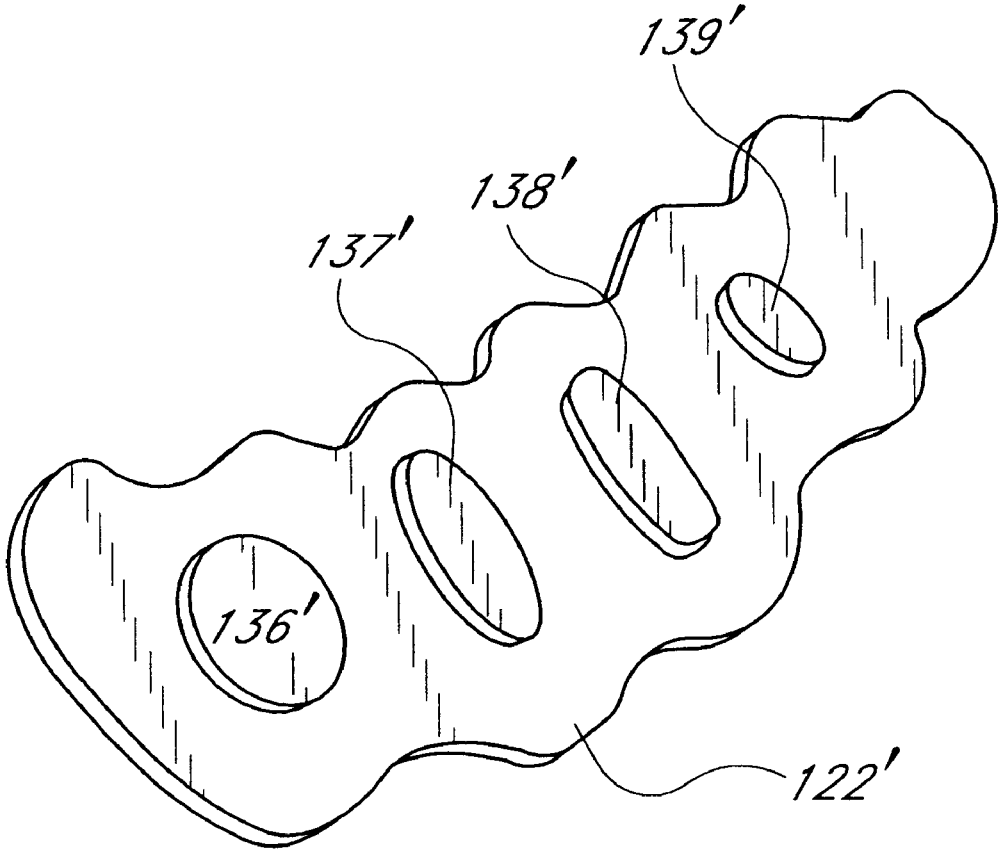
Figure 10A:
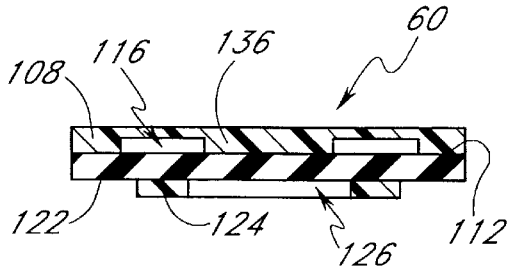
FIG. 10(*a*) is a cross-sectional view of the toe portion of the sole of FIG. 4 shown in a static state.
Figure 10B:
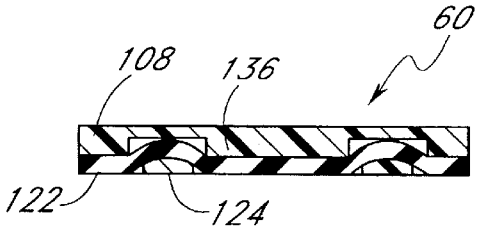
Figure 12:
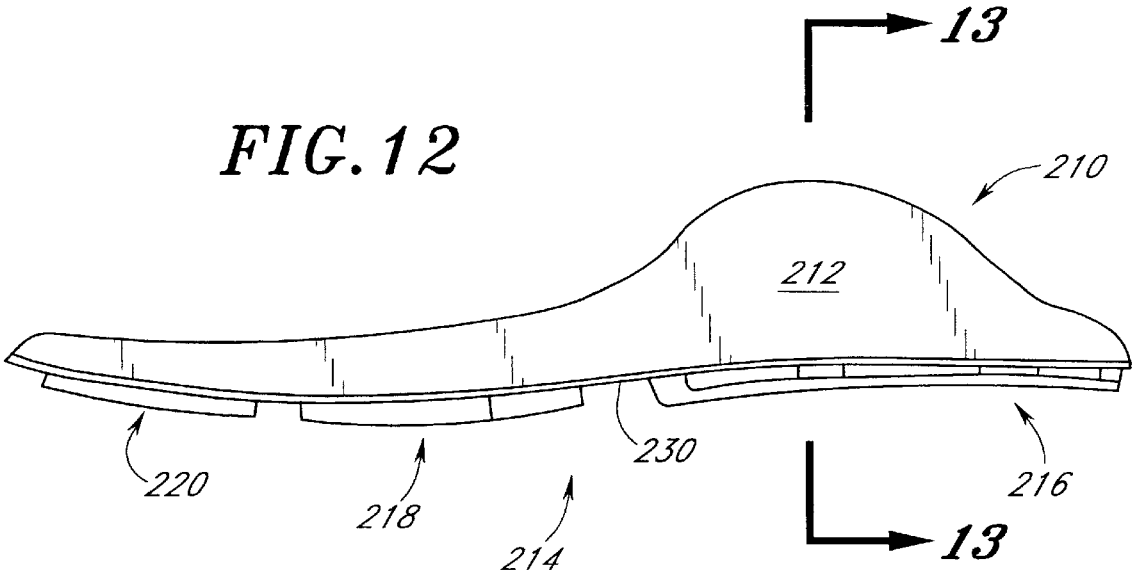
FIG. 12 is a side view in elevation showing a sole insert according to a third exemplary embodiment of the present invention.

With reference now to FIGS. 9 and 10, the construction of toe portion 60 may be seen in greater detail. Here, it may be seen that toe portion 60 is formed by a first profile piece 108 that includes a first profile by an upstanding perimeter wall 112 that extends around the peripheral edge of first profile piece 108. As may be seen with reference to FIG. 9(*a*), perimeter wall 112 is configured so that chamber 110 has five regions 116–120, that correspond to each of the human toes. A first resilient layer 122 is shown in FIG. 9(*b*) and has a peripheral edge that is geometrically congruent to first profile piece 108. When assembled, first resilient layer 122 spans across first profile chamber 110. The structure of toe portion 60 is completed with the addition of second profile piece 124 which is shown in FIG. 9(*c*). Second profile piece 124 is shaped geometrically similar to the interior side wall 113 of perimeter wall 112 so that it can nest in close-fitted, mated relation into first profile chamber 110. Second profile piece 124 is provided with openings 126–129 that define second profile chambers which correspond to toe regions 116–119. With reference again to FIG. 9(*a*), it may be seen that each of these toe regions is provided with an upstanding plunger 136–139 which are sized for mated insertion into openings 126–129, respectively.

Accordingly, as is shown in FIGS. 10(*a*) and 10(*b*), toe portion 60 provides a dual acting energy storing system. When first profile piece 108 and second profile piece 124 are moved from the static state shown in FIG. 10(*a*) to the active state shown in FIG. 10(*b*), resilient layer 122 undergoes a double deflection. Second profile piece 124, which defines the primary actuator, moves into first profile chamber 110 thus stretching resilient layer 122 into the interior region thereof. Simultaneously, each of the plungers 136–139 move into the corresponding opening 126–129 in second profile piece 124 thus stretching resilient layer 122 into the interior region of openings 126–129.

For ease of manufacture, it is possible to provide plungers 136–139 as part of resilient layer 122. Accordingly, this alternative structure is shown in FIG. 9(*d*) wherein resilient layer 122 is shown to have plunger elements 136'–139' formed integrally therewith. In FIG. 9(*d*), the opposite side of resilient layer of 122' is revealed from that shown in FIG. 9(*d*).

Figure 11A:
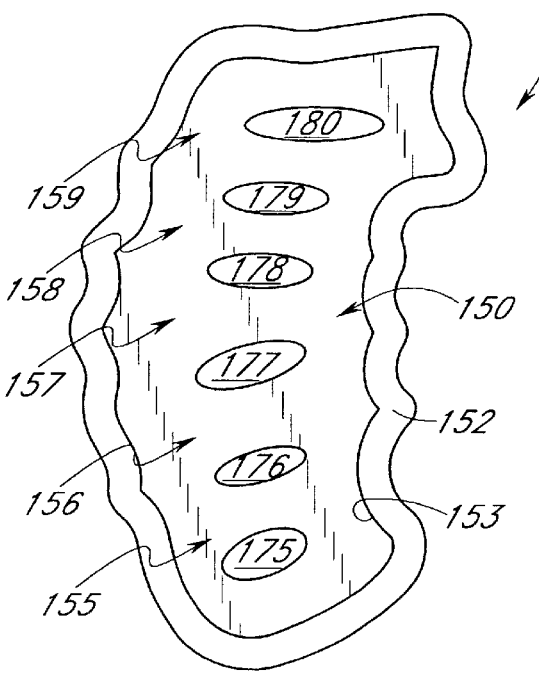
FIG. 11(*a*) is a top plan view of the first profile used to form the metatarsal portion of the sole of FIG. 4.
Figure 11C:
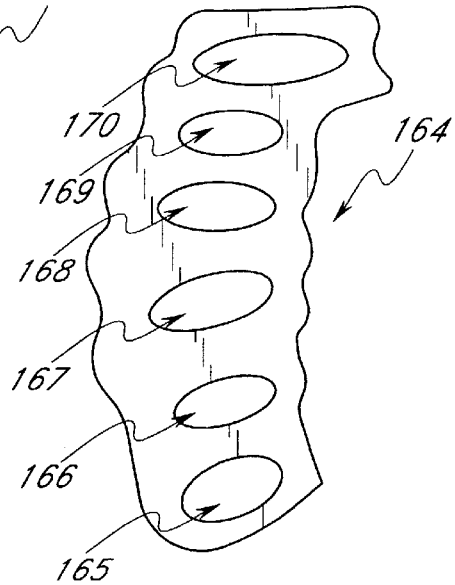
Figure 11B:
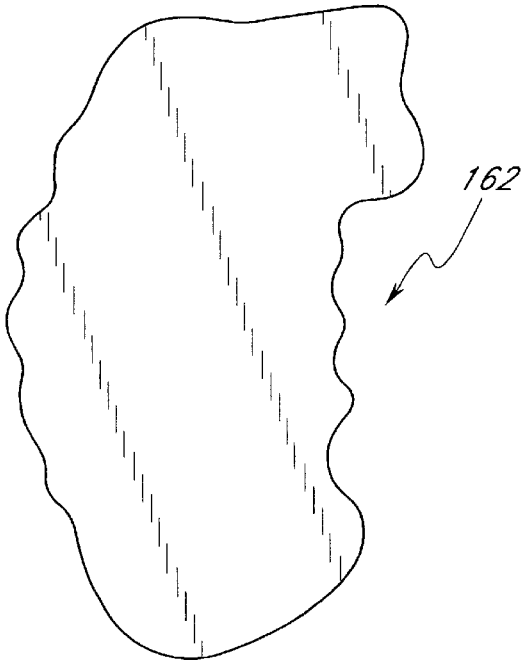

The structure of metatarsal portion 58 is similar to that of toe portion 60. In FIGS. 11(*a*)–(*c*), it may be seen that metatarsal portion 58 is formed by a first profile piece 148 that includes a first profile chamber 150 formed therein. First profile chamber 150 is thus bounded by an upstanding perimeter wall 152 that extends around the peripheral edge of first profile piece 108. As may be seen with reference to FIG. 9(*a*), perimeter wall 152 is configured so that chamber 150 has five regions 155–159, that correspond to each of the metatarsal bones. A first resilient layer 162 is shown in FIG. 11*b*) and has a peripheral edge that is geometrically congruent to first profile piece 148. When assembled, first resilient layer 162 spans across first profile chamber 150. The structure of metatarsal portion 58 is completed with the addition of second profile piece 164 which is shown in FIG. 11(*c*).

Second profile piece 164 is shaped geometrically similar to the interior side wall 153 of perimeter wall 152 so that it can nest in close-fitted, mated relation into first profile chamber 150. Second profile piece 164 is provided with openings 165–170 that define second profile chambers. With reference again to FIG. 11(*a*), it may be seen that first profile chamber 150 is provided with an upstanding plungers 175–180 which are sized for mated insertion into openings 165–170, respectively. Plungers 175–180 are oriented to extend between the metatarsal bones of the human foot.

Here again when first profile piece 148 and second profile piece 164 move from the static state to the active state, resilient layer 162 undergoes a double deflection. Second profile piece 164 which defines the primary actuator, moves into first profile chamber 150 thus stretching resilient layer 162 into the interior region thereof. Simultaneously, each of the plungers 175–180 move into the corresponding chambers 165–170 in second profile piece 164 thus stretching resilient layer 162 into the interior region of openings 165–170. The action, therefore, is identical to that described with reference to FIGS. 10(*a*) and 10(*b*).

Figure 13:
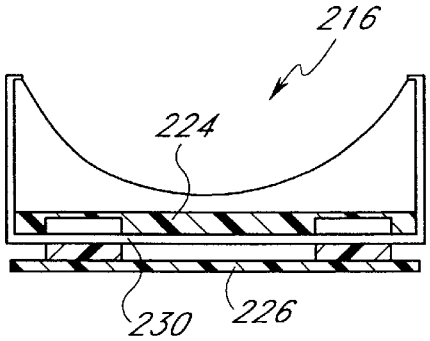
FIG. 13 is a cross-sectional view taken about lines 13—13 of FIG. 12.
Figure 15B:
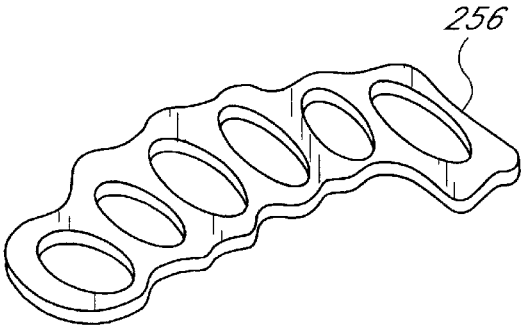
FIG. 15(*a*) is a perspective view of the first profile used to form the metatarsal portion of the sole insert of FIG. 12.
Figure 15A:
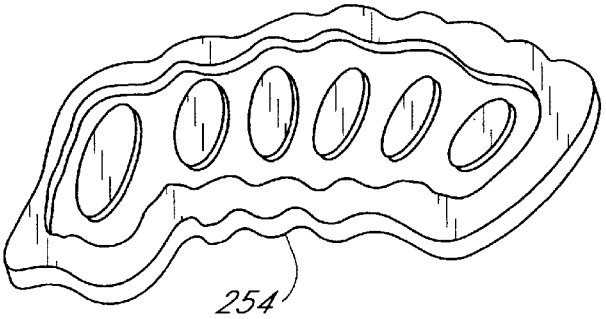
Figure 14A:
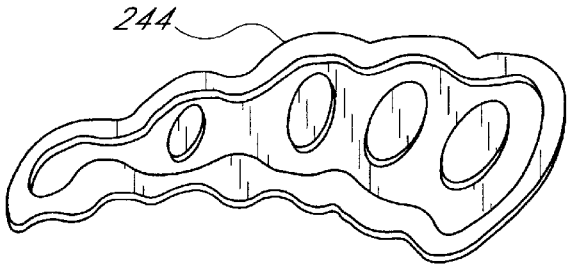
FIG. 14(*a*) is a perspective view of the first profile used to form the toe portion of the sole insert of FIG. 12.
Figure 14B:
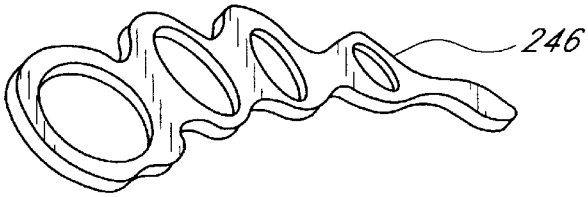
Figure 16A:
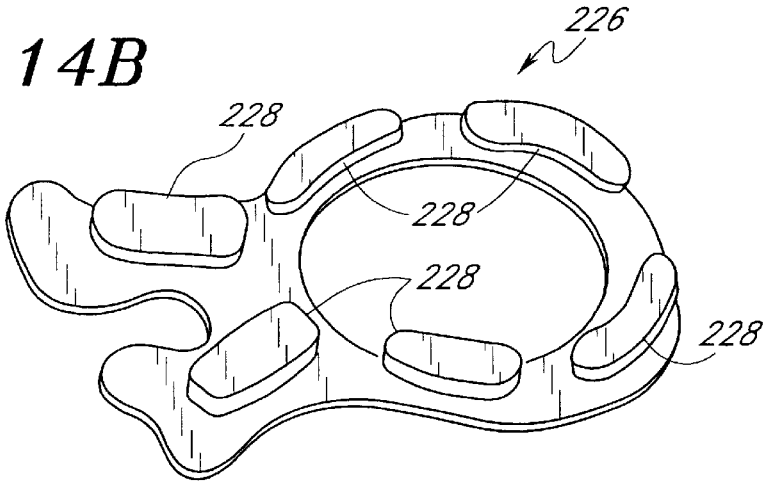
FIG. 16(*a*) is a perspective view of the first profile used to form the heel portion of the sole insert of FIG. 12.
Figure 16B:
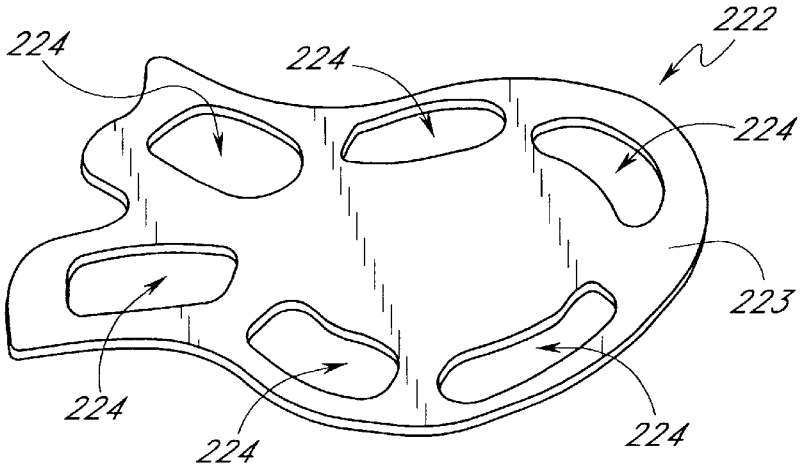

A third exemplary embodiment of the present invention is shown in FIGS. 12–16. In these figures, a sole insert 210 is shown to include an upper 212 and a sole 214. Sole 214 includes a heel section 216, a metatarsal 218 and a toe portion 220. The structure of heel portion 216 is best shown in FIGS. 13 and 16. Heel portion 216 includes a first profile piece 222 structured generally as flat plate 223 that has a plurality of first profile chambers 224 formed therein. Chambers 224 are formed as cavities in plate 223. Alternatively, chambers 224 could be formed by openings completely through plate 223. A second profile piece 226 includes a plurality of actuator elements 228 which are sized for engagement into the interior region of a respective chamber 224. First profile piece 224 and second profile piece 226 sandwich a resilient layer 230 therebetween so that, when compression forces are exerted, actuator elements 228 are advanced into first profile chamber 224.

Toe portion 220 is formed by a first profile piece 244 and a second profile piece 246 that defines an actuator. The structure of profile pieces 244 and 246 are identical to that described with respect to profile pieces 108 and 124, respectively, so that this description is not repeated. Similarly, metatarsal portion 218 is formed by a first profile piece 254 and a second profile piece 256 with the structure of profile pieces 254 and 256 being the same as that of profile pieces 148 and 164. One difference that may be noted in the structure of the sole insert 210, however, is that the resilient layer 230 is a common resilient layer that extends along the complete sole of insert 210 so that resilient layer 230 provides the resilient layers for storing energy in each of heel portion 216, metatarsal portion 218 and toe portion 220.

Accordingly, the present invention has been described with some degree of particularity directed to the exemplary embodiment(s) of the present invention. It should be appreciated, though, that the present invention is defined by the following claims construed in light of the prior art so that modifications or changes may be made to the exemplary embodiment of the present invention without departing from the inventive concepts contained herein.

I claim:

1. A sole adapted for use with an article of footwear to be worn on a foot of a person while traversing along a support surface and operative to store and release energy resulting from compressive forces between the person and the support surface, comprising:

(a) a first layer of stretchable resilient material having a first surface on a first side thereof and a second surface on a second side thereof opposite the first surface;

(b) a first profile formed of a stiff material and positioned on the first side of said resilient layer, said first profile having a first profile chamber formed therein with the first profile chamber having a first interior region opening toward the first surface of said resilient layer, said first profile and said resilient layer positioned relative to one another such that said resilient layer spans across the first interior region; and (c) a second profile formed of a stiff material and positioned on the second side of said resilient layer, said second profile including a single primary actuator element positioned to substantially individually underlie a majority of the heel of the person's foot and sized for mated insertion into the first profile chamber, the primary actuator element facing the second surface of said resilient layer to define a static state, said first and second profiles positioned relative to one another with said primary actuator element being oriented relative to the first profile chamber such that the compressive force between the foot and the support surface moves said first and second profiles toward one another and moves said primary actuator element into the first profile chamber thereby stretching said resilient layer into the first interior region to define an active state wherein energy is stored by said resilient layer, said resilient layer operative to release the energy to move said first and second profiles apart from one another upon removal of the compressive force to return said first and second profiles to the static state.

2. A sole according to claim 1 wherein said first profile is operative to contact the support surface.

3. A sole according to claim 1 wherein said second profile is operative to contact the support surface.

4. A sole according to claim 1 wherein said second profile has a second profile chamber formed within said actuator element with the second profile chamber having a second interior region opening toward the second surface such that said resilient layer spans across the second region, said sole including a plunger element disposed in the first interior region and operative to move into and out of the second interior region when said first and second profiles move between the static and active states.

5. A sole according to claim 4 including a third profile having a third profile chamber formed therein with the third profile chamber having a third interior region and including a second layer of stretchable resilient material spanning across the third region, said first profile including a secondary actuator element positioned to move into the third interior region and to stretch said second layer into the third profile chamber in response to the compressive force.

6. A sole according to claim 5 wherein said first profile includes a plurality of secondary actuators extending around a perimeter thereof to define the first profile chamber, said third profile having a plurality of third profile chambers each including a second layer of resilient material spanning thereacross and positioned to receive a respective one of said secondary actuators.

7. A sole according to claim 6 wherein said first profile and said secondary actuators are formed as an integral one-piece construction.

8. A sole according to claim 6 wherein said third profile and said plunger element are formed as an integral one-piece construction.

9. A sole according to claim 4 including a plurality of plunger elements disposed in the first interior region and operative to move into and out of the second interior region when said first and second profiles move between the static and active states.

10. A sole according to claim 4 wherein said plunger element is formed integrally with said first layer.

11. A sole according to claim 1 including a third profile having a third profile chamber formed therein with the third profile chamber having a third interior region and including a second layer of stretchable resilient material spanning across the third region, said first profile including a secondary actuator element positioned to move into the third interior region and to stretch said second layer into the third profile chamber in response to the compressive force.

12. A sole according to claim 4, wherein said second profile chamber extends entirely through the second profile.

13. In an article of footwear adapted to be worn on a foot of a person while traversing along a support surface and operative to store and release energy resulting from compressive forces between the person and the support surface, the improvement comprising a sole piece including a first layer of stretchable resilient material having a first surface on a first side thereof and a second surface on a second side thereof opposite the first surface, a first profile formed of a stiff material and positioned on the first side of said resilient layer, said first profile having a first profile chamber formed therein with the first profile chamber having a first interior region opening toward the first surface of said resilient layer, said first profile and said resilient layer positioned relative to one another such that said resilient layer spans across the first interior region, and a second profile formed of a stiff material and positioned on the second side of said resilient layer, said second profile consisting of a separate, single piece primary actuator element positioned to substantially individually underlie a portion of the person's foot selected from the group consisting of a heel portion, a toe portion and a metatarsal portion, the primary actuator element facing the second surface of said resilient layer to define a static state, said first and second profiles positioned relative to one another and said primary actuator element oriented relative to the first profile chamber such that the compressive force between the foot and the support surface moves said first and second profiles toward one another and moves said primary actuator element into the first chamber thereby stretching said resilient layer into the first interior region to define an active state wherein energy is stored by said resilient layer, said resilient layer operative to release the energy to move said first and second profiles apart from one another upon removal of the compressive force to return said first and second profiles to the static state.

14. The improvement according to claim 13 wherein said sole piece is a section selected from a group consisting of heel sections, metatarsal sections and toe sections.

15. The improvement according to claim 13 wherein said second profile has a second profile chamber formed therein with the second profile chamber having a second interior region opening toward the second surface such that said resilient layer spans across the second region, and including a plunger element disposed in the first interior region and operative to move into and out of the second interior region when said first and second profiles move between the static and active states.

16. The improvement according to claim 13 wherein the separate, single piece primary actuator element includes a plurality of sections.

17. The improvement according to claim 16 wherein each of the sections corresponds to a bone of the human foot.

18. The improvement according to claim 13 wherein the separate, single piece primary actuator element is positioned to substantially individually underlie the toe portion of the person's foot.

19. The improvement according to claim 13 wherein the separate, single piece primary actuator element is positioned to substantially individually underlie the metatarsal portion of the person's foot.

20. The improvement according to claim 13 wherein the separate, single piece primary actuator element is positioned to substantially individually underlie the heel portion of the person's foot.

21. An article of footwear adapted to be worn on a foot of a person while traversing along a support surface and operative to store and release energy resulting from compressive forces between the person and the support surface, comprising:

(a) an upper;

(b) a sole interconnected to said upper to form an enclosure for the foot of a wearer;

(c) a first layer of stretchable resilient material having a first surface on a first side thereof and a second surface on a second side thereof opposite the first surface;

(d) a first profile formed of a stiff material and positioned on the first side of said resilient layer, said first profile having a first profile chamber formed therein with the first profile chamber having a first interior region opening toward the first surface of said resilient layer, said first profile and said resilient layer positioned relative to one another such that said resilient layer spans across the first interior region; and (e) a second profile formed of a stiff material and positioned on the second side of said resilient layer, said second profile consisting of a separate, single piece primary actuator element positioned to substantially individually underlie a portion of the person's foot selected from the group consisting of a heel portion, a toe portion and a metatarsal portion, the primary actuator element facing the second surface of said resilient layer to define a static state, said first and second profiles positioned relative to one another and said primary actuator element oriented relative to the first profile chamber such that the compressive force between the foot and the support surface moves said first and second profiles toward one another and moves said primary actuator element into the first chamber thereby stretching said resilient layer into the first interior region to define an active state wherein energy is stored by said resilient layer, said resilient layer operative to release the energy to move said first and second profiles apart from one another upon removal of the compressive force to return said first and second profiles to the static state.

22. A support structure for supporting at least a portion of a foot, the support structure comprising:

a resilient layer having a first surface on a first side thereof and a second surface on a second side thereof opposite the first surface;

a profile piece positioned on the first side of the resilient layer;

a layer of stiff material positioned on the second side of the resilient layer, the layer having a first chamber sized and configured to correspond to the profile piece such that when a compressive force is applied to the support structure, the profile piece and the first chamber move toward one another and the profile piece moves into the first chamber thereby stretching the resilient layer into the first chamber; and at least one plunger positioned on the second side of the resilient layer within the first chamber;

wherein the profile piece encloses at least one second chamber for receiving the at least one plunger therein, such that when a compressive force is applied to the support structure, the plunger and the second chamber move toward one another and the plunger moves into the second chamber thereby stretching the resilient layer into the second chamber.

23. The support structure of claim 22, wherein the profile piece is positioned to substantially underlie a heel portion of the foot.

24. The support structure of claim 22, wherein the profile piece is positioned to substantially underlie a toe portion of the foot.

25. The support structure of claim 24, wherein the profile piece includes a plurality of second chambers, each second chamber corresponding to a plunger positioned to substantially underlie one of the toes of the foot.

26. The support structure of claim 22, wherein the profile piece is positioned to substantially underlie a metatarsal portion of the foot.

27. The support structure of claim 26, wherein the profile piece includes a plurality of second chambers, each second chamber corresponding to a plunger positioned to at least partially cradle one of the metatarsal bones of the foot.

28. A support structure for supporting at least a toe portion of a human foot, the support structure comprising:

a layer of resilient material having a first surface on a first side thereof and a second surface on a second side thereof opposite the first surface;

a first profile piece formed of a stiff material and positioned on the first side of the resilient layer, the first profile piece including an upstanding perimeter wall having an interior side wall defining a first profile chamber, the chamber having five regions, each region individually corresponding to one of the human toes;

a plurality of upstanding plungers, each of the plungers provided in a corresponding one of the five regions so as to substantially individually underlie one of the human toes;

a second profile piece formed of a stiff material and positioned on the second side of the resilient layer, the second profile piece being shaped geometrically similar to the interior side wall of the upstanding perimeter wall so that it can nest in close-fitted, mated relation into the first profile chamber; and a plurality of openings in the second profile piece, each of these openings defining a second profile chamber corresponding to each of the plurality of upstanding plungers, each of the upstanding plungers being sized for mated insertion into each of the corresponding openings.

29. The support structure of claim 28, wherein the layer of resilient material has a peripheral edge that is geometrically congruent to the first profile piece.

30. The support structure of claim 28, wherein the layer of resilient material extends substantially across the entire length and width of the foot.

31. The support structure of claim 28, wherein the plurality of upstanding plungers includes four plungers corresponding to each of the first to fourth toes.

32. The support structure of claim 28, wherein the plurality of upstanding plungers is formed integrally with the layer of resilient material.

33. A support structure for supporting at least a metatarsal portion of a human foot, the support structure comprising:

a layer of resilient material having a first surface on a first side thereof and a second surface on a second side thereof opposite the first surface;

a first profile piece formed of a stiff material and positioned on the first side of the resilient layer, the first profile piece including an upstanding perimeter wall having an interior side wall defining a first profile chamber, the chamber having five regions, each region individually corresponding to one of the metatarsal bones;

a plurality of upstanding plungers provided in the first profile chamber, the plurality of plungers being oriented to cradle each of the metatarsal bones such that each of the five metatarsal bones extends over one of the five regions of the first profile chamber between two adjacent plungers;

a second profile piece formed of a stiff material and positioned on the second side of the resilient layer, the second profile piece being shaped geometrically similar to the interior side wall of the upstanding perimeter wall so that it can nest in close-fitted, mated relation into the first profile chamber; and a plurality of openings in the second profile piece, each of these openings defining a second profile chamber corresponding to each of the plurality of upstanding plungers, each of the upstanding plungers being sized for mated insertion into each of the corresponding openings.

34. The support structure of claim 33, wherein the layer of resilient material has a peripheral edge that is geometrically congruent to the first profile piece.

35. The support structure of claim 33, wherein the layer of resilient material extends substantially across the entire length and width of the foot.

36. The support structure of claim 33, wherein the plurality of upstanding plungers includes six plungers to cradle each of the five metatarsal bones.

37. The support structure of claim 33, wherein the plurality of upstanding plungers is formed integrally with the layer of resilient material.

38. A support structure for supporting at least a toe portion of a human foot, the support structure comprising:

a layer of resilient material having a first surface on a first side thereof and a second surface on a second side thereof opposite the first surface;

a profile piece formed of a stiff material and positioned on the first side of the resilient layer, the profile piece having no more than five chambers therein facing the first surface, each of the chambers corresponding individually to one of the human toes and positioned to substantially underlie one of the human toes; and a plurality of actuators positioned on the second side of the resilient layer, each actuator corresponding to one of the chambers in the profile piece and being sized for mated insertion into the corresponding chamber.

39. The support structure of claim 38, wherein the profile piece extends substantially across only the length and width of the toe portion of the human foot.

40. The support structure of claim 39, wherein the layer of resilient material has a peripheral edge that is geometrically congruent to the profile piece.

41. The support structure of claim 38, wherein each of the actuators is a plunger that is substantially oval in shape.

42. The support structure of claim 38, wherein the plurality of chambers includes four chambers corresponding to each of the first to fourth toes.

43. The support structure of claim 38, wherein each chamber is an opening extending entirely through the profile piece.

44. A support structure for supporting at least a metatarsal portion of a human foot, the support structure comprising:

a layer of resilient material having a first surface on a first side thereof and a second surface on a second side thereof opposite the first surface;

a profile piece formed of a stiff material and positioned on the first side of the resilient layer, the profile piece having a plurality of chambers therein facing the first surface; and a plurality of actuators positioned on the second side of the resilient layer, each actuator corresponding to one of the chambers in the profile piece and being sized for mated insertion into the corresponding chamber, and wherein the plurality of actuators is oriented to cradle at least one metatarsal bone such that the at least one metatarsal bone extends over an area between two adjacent actuators.

45. The support structure of claim 44, wherein the profile piece extends substantially across only the length and width of the metatarsal portion of the human foot.

46. The support structure of claim 45, wherein the layer of resilient material has a peripheral edge that is geometrically congruent to the profile piece.

47. The support structure of claim 44, wherein each of the actuators is a plunger that is substantially oval in shape.

48. The support structure of claim 44, wherein the plurality of actuators includes six actuators to cradle each of the five metatarsal bones, such that each of the five metatarsal bones extends over an area between two adjacent actuators.

49. The support structure of claim 44, wherein each chamber is an opening extending entirely through the profile piece.

* * * * *